US008695371B2

(12) United States Patent
Boarman et al.

(10) Patent No.: US 8,695,371 B2
(45) Date of Patent: Apr. 15, 2014

(54) REFRIGERATOR DISPENSER ASSEMBLY INCLUDING A WATER CONDITIONING CARTRIDGE

(75) Inventors: Patrick J. Boarman, Evansville, IN (US); Daniel John Aust, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1517 days.

(21) Appl. No.: 11/924,083

(22) Filed: Oct. 25, 2007

(65) Prior Publication Data

US 2008/0148763 A1 Jun. 26, 2008

Related U.S. Application Data

(60) Provisional application No. 60/876,513, filed on Dec. 22, 2006.

(51) Int. Cl.

| | |
|---|---|
| ***F25D 3/00*** | (2006.01) |
| ***F25B 21/02*** | (2006.01) |
| ***B67D 7/80*** | (2010.01) |
| ***B01D 35/30*** | (2006.01) |

(52) U.S. Cl.

USPC ..... 62/390; 62/3.64; 62/389; 222/146.1; 210/232

(58) Field of Classification Search

USPC ..... 62/3.64, 389, 390; 222/146.1; 210/232

See application file for complete search history.

(56) References Cited

U.S. PATENT DOCUMENTS

| | | | | |
|---|---|---|---|---|
| 2,031,599 | A | 2/1936 | Gudmundsen | |
| 2,408,704 | A | 10/1946 | Taylor | |
| 4,440,318 | A * | 4/1984 | Berger | 222/129.1 |
| 5,590,532 | A * | 1/1997 | Bachman | 62/3.3 |
| 5,603,230 | A | 2/1997 | Tsai | |
| 5,603,257 | A * | 2/1997 | Kateman et al. | 99/455 |
| 5,619,856 | A * | 4/1997 | Lee | 62/3.64 |
| 5,956,967 | A * | 9/1999 | Kim | 62/390 |
| 6,370,884 | B1 * | 4/2002 | Kelada | 62/3.64 |
| 6,418,730 | B1 * | 7/2002 | Tremblay et al. | 62/3.64 |
| 2003/0188540 | A1 * | 10/2003 | Van Winkle | 62/3.64 |
| 2004/0202457 | A1 | 10/2004 | Kim et al. | |

(Continued)

FOREIGN PATENT DOCUMENTS

| | | | |
|---|---|---|---|
| EP | 1677061 | A2 | 7/2006 |
| KR | 1998003727 | A | 12/1998 |

(Continued)

OTHER PUBLICATIONS

European Patent Application No. 07254644.3 filed Nov. 30, 2007, Applicant: Whirlpool Corporation; European Search Report re: Same, mail date Nov. 21, 2013.

*Primary Examiner* — Allen Flanigan
*Assistant Examiner* — Filip Zec

(57) ABSTRACT

A refrigerator includes a water conditioning cartridge having a filter for removing impurities from water and a temperature control unit for selectively developing cold and heated water that is released from a refrigerator dispenser. The temperature control unit is preferably formed from one or more thermal electric coolers. The thermal electric cooler(s) include a plurality of heat sinks that develop cool and hot temperatures to treat or condition the water. A fan is positioned adjacent the thermal electric cooler(s) to provide air exchange for the plurality of heat sinks. The temperature control unit conditions, i.e., heats or cools water passing from the filter to the dispenser depending upon a selected consumer preference.

20 Claims, 2 Drawing Sheets

(56) References Cited

U.S. PATENT DOCUMENTS

| | | | | |
|---|---|---|---|---|
| 2005/0072178 | A1 | 4/2005 | Park et al. | |
| 2005/0098491 | A1* | 5/2005 | Carlotto | 210/232 |
| 2005/0269361 | A1* | 12/2005 | Prabucki | 222/146.6 |
| 2006/0080991 | A1 | 4/2006 | An et al. | |

FOREIGN PATENT DOCUMENTS

| | | | |
|---|---|---|---|
| WO | 0170621 | A1 | 9/2001 |
| WO | 03099732 | A1 | 12/2003 |
| WO | 2004092664 | A1 | 10/2004 |

* cited by examiner

REFRIGERATOR DISPENSER ASSEMBLY INCLUDING A WATER CONDITIONING CARTRIDGE

CROSS-REFERENCE TO RELATED APPLICATION

The present application claims the benefit of U.S. Provisional Patent Application Ser. No. 60/876,513 filed Dec. 22, 2006 entitled "Refrigerator Dispenser Assembly Including a Water Conditioning Cartridge."

BACKGROUND OF THE INVENTION

1. Field of the Invention

The present invention pertains to the art of refrigerators and, more particularly, to a refrigerator dispenser assembly including a water conditioning cartridge.

2. Description of the Related Art

Refrigerators having built-in ice/water dispensers are well known in the art. Typically, the dispensers are mounted to a door of the refrigerator and enable a consumer to obtain ice and/or water without requiring access to a refrigerator compartment. Many early model dispensers did not condition the water dispensed through the door. That is, the water dispensed was, in most cases, the same water coming from the kitchen tap. Overtime, manufactures incorporated filters into refrigerators to filter the water dispensed at the dispenser. In most cases, the filter would also be arranged to remove impurities from water feeding the ice maker. In addition to filters, many refrigerators include reservoirs that store filtered water prior to dispensing, thereby enabling the water to be chilled prior to delivery to a consumer. In this manner, the consumer has direct access to a supply of chilled water that could be used for drinking or cooking purposes. However, given the size of the reservoir, the amount of chilled water is limited and can be quickly depleted. When the reservoir is emptied, the consumer would be required to wait a significant period of time before having access to chilled water.

In addition to providing chilled water, manufactures recognized the benefit of dispensing heated water. Heated water could be used for cooking and/or preparation of heated beverages such as coffee, tea, cocoa and the like. However, in order to provide heated water, the refrigerator required an additional heating system. In some cases, a refrigerator was fitted with another reservoir to store the heated water. As with the above described system, the reservoir had a limited capacity and was capable of filling only a small container before needing time to heat additional water. In order to provide a larger volume of heated water, some manufacturers incorporated a heater mounted directly to a hot water line. With this arrangement, water passing through the hot water line was heated prior to being dispensed. Regardless, the additional systems added to the cost and complexity of manufacture. Moreover, the separate systems provided additional failure points for the appliance.

Based on the above, there still exists a need for a refrigerator having a dispenser that can effectively provide filtered cold and heated water. More specifically, there exists a need for a refrigerator having a single system that not only filters the water, but also operates to chill or heat the water as needed, depending upon consumer preferences.

SUMMARY OF THE INVENTION

The present invention is directed to a refrigerator including a cabinet within which is provided at least one refrigerated compartment. A door, pivotally mounted to the cabinet, selectively provides access to the at least one refrigerated compartment. In accordance with the invention, the refrigerator includes a dispenser assembly having a dispenser mounted in the door for selectively releasing chilled or heated water to a consumer. The dispenser assembly also includes a water conditioning cartridge fluidly connected to the dispenser that filters and develops a desired temperature of the water passing to the dispenser.

More specifically, the water conditioning cartridge includes an input port adapted to receive water from a water supply, an output port fluidly connected to the dispenser, a filter for removing impurities from the water and a temperature control device for selectively developing cold and heated water that is released from the dispenser depending upon consumer preferences. The temperature control device is fluidly connected to the filter and is preferably arranged downstream of the filter. The temperature control unit includes a central water treatment portion having mounted thereto one or more thermal electric coolers. The thermal electric coolers include a plurality of heat sinks that develop cool and hot temperatures to condition the water in the water treatment portion. A fan is positioned adjacent the thermal electric coolers to provide air exchange for the plurality of heat sinks. In any case, the temperature control unit conditions, i.e., heats or cools the water passing from the filter to the dispenser depending upon consumer preferences. With this arrangement, the present invention avoids the need for additional reservoirs, thereby saving space. Moreover, the present invention provides an endless supply of cold, room temperature or heated water.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
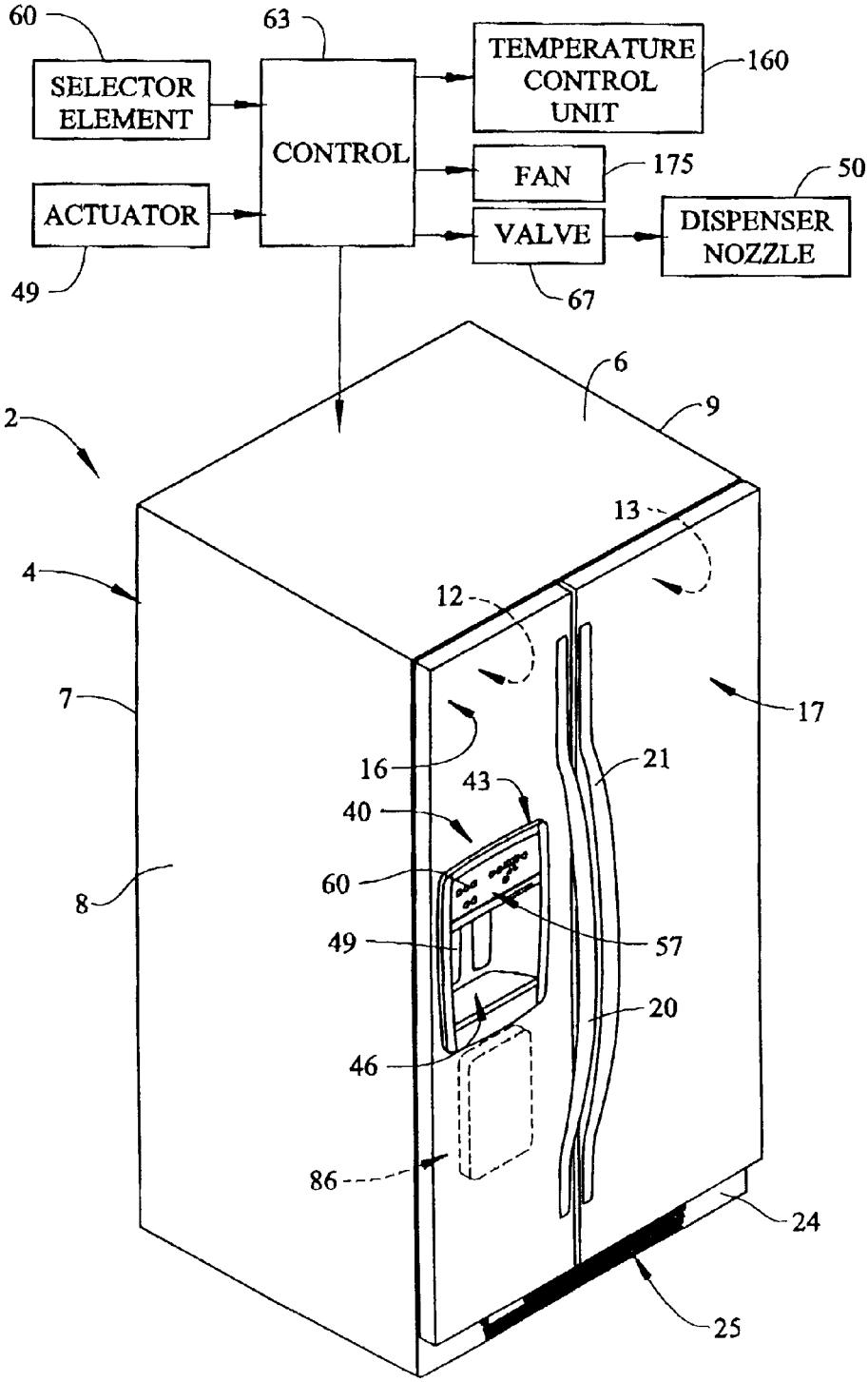
FIG. 1 is an upper left perspective view of a refrigerator incorporating a dispenser assembly including a water conditioning cartridge constructed in accordance with the present invention.

With initial reference to FIG. 1, a refrigerator constructed in accordance with the present invention is generally indicated at 2. Refrigerator 2 includes a cabinet 4 having a top wall 6, a rear wall 7 and opposing side walls 8 and 9. In the embodiment shown, refrigerator 2 constitutes a side-by-side model having a freezer compartment 12 and a fresh food compartment 13. Freezer compartment 12 has an associated freezer compartment door 16 and, likewise, fresh food compartment 13 includes a fresh food compartment door 17. Each compartment door 16, 17 includes a corresponding handle 20, 21 that enables a consumer to selectively access freezer compartment 12 and fresh food compartment 13 respectively. A kick plate 24 is arranged below freezer compartment 12 and fresh food compartment 13. Kick plate 24 includes a vent or opening 25 that provides an airflow to a refrigeration system (not shown). At this point, it should be understood that, while the present invention is shown and described in connection with a side-by-side refrigerator, refrigerator 2 can take on various forms, such as top mount and bottom mount models, as well as units employing French-style doors and units that include either a single fresh food compartment or a single freezer compartment.

Refrigerator 2 is provided with a dispenser assembly 40 including a dispenser 42 shown arranged on freezer compartment door 16. Dispenser 42 includes a facade 43 and a dispenser well 46. Arranged within dispenser well 46 is one or more actuators 49 and a nozzle schematically illustrated at 50. Dispenser 42 is also shown to include a control panel 57 having a plurality of selector elements, one of which is indicated at 60. In a manner known in the art, actuator 49 is triggered when engaged by a container (not shown) to activate a control 63 which causes water and/or ice to be dispensed. When dispensing water, control 63 activates a valve 67 which causes water to be directed through nozzle 50 and into the container. As will be discussed more fully below, prior to exiting nozzle 50, the water is passed through a water conditioning cartridge 86. Water conditioning cartridge 86 filters the water, while also developing a desired temperature for the water. More specifically, based on a consumer's input through, for example, selector element 60, water conditioning cartridge 86 establishes a flow of either cold or heater water which is advantageously directed to nozzle 50. In this manner, cold, heated and room temperature water is available from a single location, i.e., nozzle 50.

Figure 2:
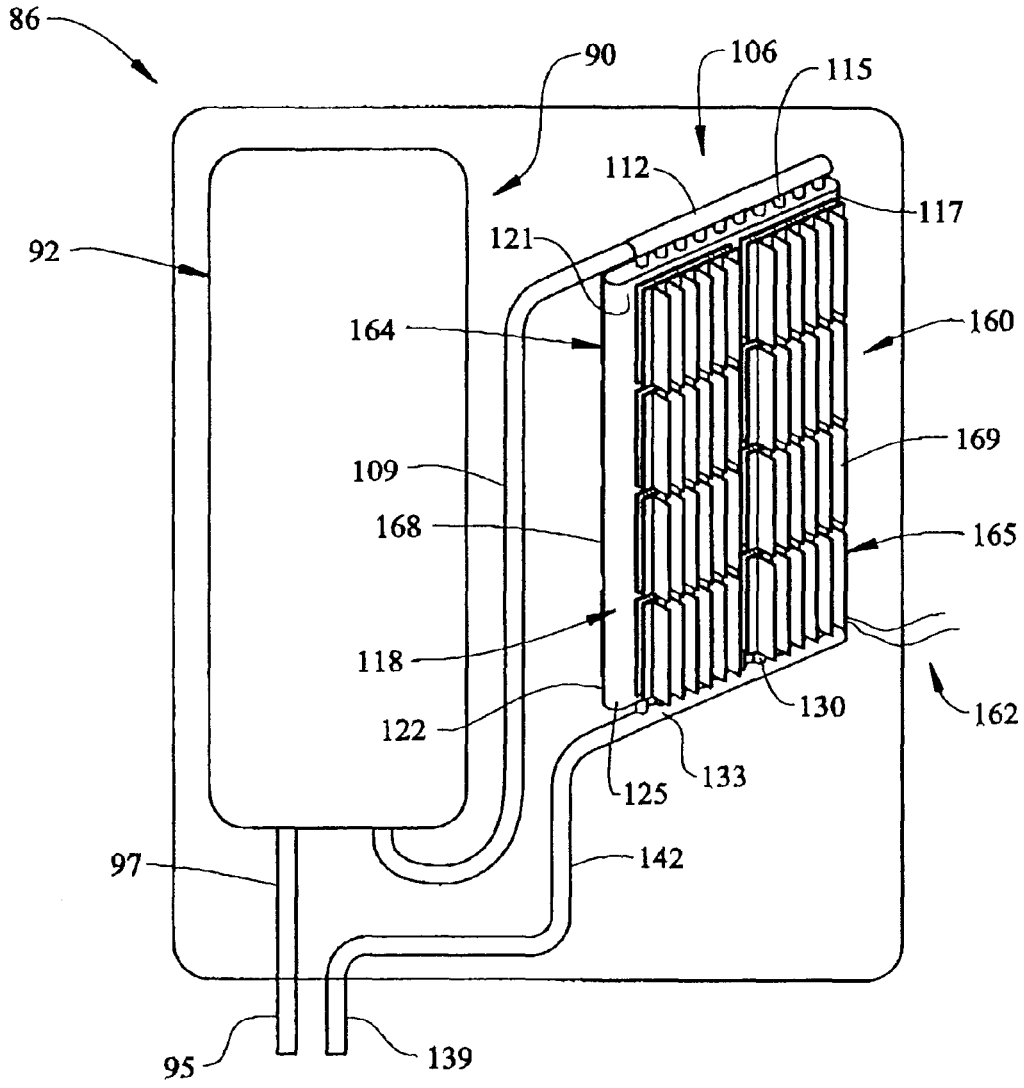
FIG. 2 is a plan view of the water conditioning cartridge of the present invention.

As best shown in FIG. 2, water conditioning cartridge 86 is a fully integrated unit that is readily replaceable within refrigerator 2. In the preferred embodiment shown, water conditioning cartridge 86 is housed within freezer compartment door 16. In any event, water conditioning cartridge 86 includes a filter portion 90 having a water filter 92 that removes impurities from water passing through water conditioning cartridge 86. Towards that end, water filter 92 is fluidly connected to an inlet port 95 of water conditioning cartridge 86 through an inlet conduit 97. Water filter 92 is also fluidly connected to a temperature control portion 106 through an intermediate conduit 109. Although not shown, a consumer is provided with access to water conditioning cartridge 86 on an inner panel (also not shown) of freezer compartment door 16 in order to allow for periodic replacement.

In accordance with the invention, temperature control portion 106 includes a first or input manifold 112 having a plurality of feeder tubes, one of which is indicated at 115. Input manifold 112 is fluidly connected to intermediate conduit 109, while feeder tubes 115 connect to a first end portion 117 of a water treatment unit 118. As shown, water treatment unit 118 is preferably constituted by a flat, thin tank. Water treatment unit 118 extends from first end portion 117 through first and second opposing planar surfaces 121 and 122 to a second end portion 125. Second end portion 125 is provided with a plurality of discharge tubes, one of which is indicated at 130, that feed into a discharge manifold 133. With this arrangement, filtered water is delivered into water treatment unit 118 through feeder tubes 115, directed through the tank, and discharged into discharge manifold 133. Discharge manifold 133 guides treated water from temperature control portion 106 to an outlet port 139 through a discharge conduit 142.

In further accordance with the invention, water passing through water treatment unit 118 is, depending upon a consumer's demand, subjected to a temperature conditioning process by a temperature control unit 160. Preferably, temperature control unit 160 operates on low voltages supplied through conductor 162 that are operatively connection within refrigerator 2 when cartridge 86 is in place. The temperature conditioning process should be understood to include both the addition of heat, i.e., developing heated water that is passed to dispenser nozzle 50, and the removal of heat, i.e., developing cool water which is likewise passed to dispenser nozzle 50. Of course, the present invention could also simply supply filtered water at room temperature.

In accordance with the most preferred form of the invention, temperature control unit 160 is constituted by first and second thermal electric coolers (TEC) 164 and 165 arranged on first and second planar surfaces 121 and 122 respectively. Although various, varying capacity thermoelectric arrangements are known in the art, TEC's 164 and 165 are preferably configured to remove approximately 306 watts/cm$^2$ from water passing through water treatment unit 118. Towards that end, each TEC 164, 165 includes a plurality of fins 168, 169 that facilitate heat transfer to and from water treatment unit 118. In order to further facilitate heat transfer, a fan 175 is operatively connected to control 63 and arranged adjacent temperature control unit 160. Fan 175 directs an airflow across the plurality of fins 168 and 169, which are exposed to the outside of water conditioning cartridge 86, to increase an overall heat transfer rate between TEC 164, TEC 165 and water treatment unit 118, thereby ensuring maximum heat delivery and/or removal from any water passing from input port 95 to outlet port 139.

Although described with reference to a preferred embodiment of the invention, it should be readily understood that various changes and/or modifications can be made to the invention without departing from the spirit thereof. In general, it should be readily understood that the present invention provides for a fully integrated and easily replaceable cartridge that can advantageously develop both cool and heated, filtered water for a refrigerator dispenser. In addition, the overall water conditioning cartridge can be easily replaced, such as when the filter reaches an expiration date. Furthermore, the present invention provides for a readily available supply of water without the need for additional reservoirs. That is, the present invention provides an endless supply of cool, heated or room temperature water to a single outlet on the dispenser. With this arrangement, consumers are ensured of the continued treatment of water delivered from the dispenser without requiring costly servicing in the event of a component failure. In any case, the invention is only intended to be limited by the scope of the following claims.

What is claimed is:

1. A refrigerator comprising:

a cabinet;

at least one refrigerated compartment provided in the cabinet;

a door pivotally mounted to the cabinet for selectively providing access to the at least one refrigerated compartment; and a dispenser assembly including:

a dispenser for selectively dispensing water to a consumer;

a temperature selector member enabling a consumer to select chilled or heated water for dispensing; and a replaceable water conditioning cartridge fluidly connected to the dispenser, said water conditioning cartridge including a filter for removing impurities from the water and a temperature control unit fluidly connected to the filter, said temperature control unit being linked to the temperature selector member for developing a select one of chilled or heated water for dispensing from the dispenser.

2. The refrigerator according to claim 1, wherein the temperature control unit is positioned downstream of the filter.

3. The refrigerator according to claim 1, wherein the temperature control unit is constituted by a thermal electric cooler.

4. The refrigerator according to claim 3, wherein the thermal electric cooler includes a plurality of heat sinks which are exposed on the water conditioning cartridge.

5. The refrigerator according to claim 4, further comprising: a fan positioned adjacent the thermal electric cooler to provide air exchange across the plurality of heat sinks.

6. The refrigerator according to claim 4, wherein the dispenser is provided on the door and includes a single outlet nozzle for dispensing the select one of chilled or heated water.

7. The refrigerator according to claim 1, wherein the water conditioning cartridge is readily, removably mounted in the door.

8. The refrigerator according to claim 7, wherein the dispenser assembly includes a façade having arranged thereon a plurality of control elements for selectively activating the dispenser, at least one of said plurality of control elements being the temperature selector element.

9. A refrigerator comprising:

a cabinet;

at least one refrigerated compartment provided in the cabinet;

a door pivotally mounted to the cabinet for selectively providing access to the at least one refrigerated compartment; and a dispenser assembly including:

a dispenser including an outlet nozzle for selectively dispensing water to a consumer;

a temperature selector member enabling a consumer to select chilled or heated water for dispensing; and a replaceable water conditioning cartridge fluidly connected to the dispenser, said water conditioning cartridge including a temperature control unit, which is linked to the temperature selector member, for developing a select one of chilled or heated water for dispensing from the dispenser through the outlet nozzle.

10. The refrigerator according to claim 9, wherein the water conditioning cartridge further includes a filter and the temperature control unit is positioned downstream of the filter.

11. The refrigerator according to claim 9, wherein the temperature control unit is constituted by a thermal electric cooler.

12. The refrigerator according to claim 11, wherein the thermal electric cooler includes a plurality of heat sinks that develop cool and hot temperatures to condition the water.

13. The refrigerator according to claim 12, further comprising: a fan positioned adjacent the thermal electric cooler to provide air exchange for the plurality of heat sinks.

14. The refrigerator according to claim 9, wherein the water conditioning cartridge is readily, removably mounted in the door.

15. The refrigerator according to claim 9, wherein the dispenser assembly includes a façade having arranged thereon a plurality of control elements for selectively activating the dispenser, at least one of said plurality of control elements being the temperature selector element.

16. A replaceable water conditioning cartridge for a refrigerator dispenser comprising:

an input port adapted to receive water from a water supply;

an output port adapted to be fluidly connected to a refrigerator dispenser;

a filter interposed between the input port and output port for removing impurities from the water; and a temperature control unit fluidly connected to the filter, said temperature control device developing a select one of chilled or heated water for delivery to the output port.

17. The water conditioning cartridge according to claim 16, wherein the temperature control unit is arranged downstream of the filter.

18. The water conditioning cartridge according to claim 16, wherein the temperature control unit is constituted by a thermal electric cooler.

19. The water conditioning cartridge according to claim 18, wherein the thermal electric cooler includes a plurality of heat sinks that develop cool and hot temperatures to condition the water.

20. A refrigerator comprising:

a cabinet;

at least one refrigerated compartment provided in the cabinet;

a door pivotally mounted to the cabinet for selectively providing access to the at least one refrigerated compartment; and a dispenser assembly including:

a dispenser including an outlet nozzle for selectively dispensing water to a consumer;

a temperature selector member enabling a consumer to select chilled or heated water for dispensing; and a replaceable water conditioning cartridge fluidly connected to the dispenser, said water conditioning cartridge combining an input port adapted to receive water from a water supply, an output port adapted to be fluidly connected to the dispenser, a filter interposed between the input port and output port for removing impurities from the water and a temperature control unit fluidly connected to the filter as a fully integrated unit, said temperature control unit being linked to the temperature selector member for developing a select one of chilled or heated water for delivery to the output port and dispensing from the dispenser through the outlet nozzle.

* * * * *